US008176968B1

(12) United States Patent
Eshleman et al.

(10) Patent No.: US 8,176,968 B1
(45) Date of Patent: May 15, 2012

(54) VENT PASSAGE HEATERS TO REMOVE CORE GAS FROM CASTING DIES

(75) Inventors: Brad Eshleman, Minster, OH (US); Tim Hider, Minster, OH (US)

(73) Assignee: Honda Motor Co., Ltd., Tokyo (JP)

( * ) Notice: Subject to any disclaimer, the term of this patent is extended or adjusted under 35 U.S.C. 154(b) by 674 days.

(21) Appl. No.: 12/325,496

(22) Filed: Dec. 1, 2008

(51) Int. Cl.
*B22D 17/00* (2006.01)
*B22D 17/22* (2006.01)

(52) U.S. Cl. ..... 164/113; 164/305; 164/338.1; 164/410

(58) Field of Classification Search ..... 164/305, 164/410, 338.1, 113, 312
See application file for complete search history.

(56) References Cited

U.S. PATENT DOCUMENTS 4,298,051 A 11/1981 Page
4,314,765 A 2/1982 Hotz
4,413,666 A 11/1983 Page
4,637,451 A 1/1987 Perrella et al.
4,708,641 A 11/1987 Meininger
4,766,943 A 8/1988 Page
4,798,237 A 1/1989 Nakano
4,961,458 A 10/1990 Downing
4,976,305 A * 12/1990 Tanaka et al. ..... 164/458
5,306,132 A 4/1994 Grundmann et al.
5,480,606 A 1/1996 Julian
5,770,245 A 6/1998 Takizawa et al.
5,913,355 A 6/1999 Muramatsu
6,250,365 B1 6/2001 Flemings et al.
6,827,569 B2 12/2004 Wieder
6,929,464 B2 8/2005 Suzuki
7,025,116 B2 4/2006 Suzuki et al.

FOREIGN PATENT DOCUMENTS

JP 60-137624 A * 7/1985

* cited by examiner

*Primary Examiner* — Kevin P Kerns
(74) *Attorney, Agent, or Firm* — Rankin Hill & Clark LLP

(57) ABSTRACT

A metal casting system and related method are described that eliminate or at least significantly reduce deposition and buildup of resinous materials in gases vented during a casting operation. One or more heating assemblies are provided in vent passageways in the casting equipment, and particularly in the casting dies. The heating assemblies maintain exposed vent passageway surfaces at relatively high temperatures.

20 Claims, 8 Drawing Sheets

VENT PASSAGE HEATERS TO REMOVE CORE GAS FROM CASTING DIES

FIELD OF THE INVENTION

The presently disclosed embodiments are directed to the field of casting molten metals.

BACKGROUND OF THE INVENTION

Die casting refers to a process in which molten metal is introduced into a mold or set of dies to form cast items having shapes defined by one or more hollow regions in the dies. Many casting operations utilize expendable cores that are positioned in the casting chamber such that the molten metal flows around the core. After solidification of the cast metal part, the core can be removed to reveal an undercut or hollow region in the resulting metal part. This process is typically referred to as casting with expendable cores. Expendable cores can be formed from a wide array of materials. Many such cores are formed from foundry sand dispersed with a resinous binder.

As molten metal flows into the casting chamber, air or other gases residing therein are displaced and must be directed out of the chamber. If gases remain in the chamber during a casting operation, the gases can result in voids, depressions, or other structural discontinuities in the cast metal item. Accordingly, artisans have incorporated a wide array of vents and venting systems in casting equipment and casting dies to remove such gases from the casting chamber.

A problem associated with casting molten metals, and particularly when using expendable sand cores mixed with resinous binder, is that the extremely high temperature metals frequently generate gases within the casting chamber. This is largely due to contact between the molten metal and the binder in the core and/or other volatilizable materials exposed within the casting chamber. The extremely hot molten metal rapidly vaporizes these materials(s) within the chamber.

The volatilized material(s) or gases, are typically removed from the casting chamber by a venting system. However, as the gases exit the casting chamber and travel through the vents, materials in the gases may deposit on the interior vent surfaces. These deposits may originate from numerous sources, however they are typically volatilized binder from expendable cores and/or from other materials within the casting chamber. If the resulting deposits on vent surfaces are not periodically removed, the vents can become blocked or flow therethrough can become restricted. Blocked or restricted flow in one or more vent passages can then result in the previously described structural discontinuities in the cast items if gases are not readily directed out of the chamber. Thus, many manufacturing facilities require frequent maintenance of their casting equipment, and particularly, require removal of deposits or other buildup along interior vent surfaces.

Accordingly, a need exists for a strategy by which deposit of materials in vent passageways can be prevented or at least significantly reduced. Related to this, it would be beneficial to provide a casting system which eliminated or at least significantly reduced the tendency for such deposits in vents. In addition to avoiding the potential of poorly formed cast items, prevention of such deposits would also reduce the extent of maintenance otherwise required.

SUMMARY OF THE INVENTION

The difficulties and drawbacks associated with previous-type systems are overcome in the present method and apparatus for a vented metal casting system.

In one aspect, the present invention comprises a vented metal casting system comprising a first die defining a first interior casting surface adapted to receive and contact molten metal. The system also comprises a second die defining a second interior casting surface also adapted to receive and contact molten material. The second die is positionable with the first die between open and closed states such that upon positioning the second die in a closed state, the first interior casting surface and the second interior casting surface define an interior casting chamber. At least one of the first die and the second die define a vent passageway extending from a region located along an upper surface of the casting chamber. The system also comprises a heating element in thermal communication with the vent passageway. The heating element is configured and positioned in relation to the vent passageway to prevent or at least substantially prevent material deposition from gases flowing through the vent passageway from the casting chamber during a casting operation.

In another aspect, the present invention comprises a vented casting system comprising a plurality of dies, the dies defining a casting chamber for receiving molten metal in a casting operation. The system also comprises a cooling block in thermal communication with at least one of the dies. The system further comprises a vent passage defined by at least one of the dies and the cooling block, the vent passage extending from the casting chamber and adapted to direct gases out of the casting chamber. And, the system comprises a heating assembly disposed in the vent passage.

In yet another aspect, the present invention comprises a method for preventing or at least substantially preventing deposition of materials in a vent flow from a casting chamber during a casting operation. The casting operation is performed in a casting system including at least two dies positionable between an open state and a closed state and which define when in the closed state the casting chamber, at least one of the first and second dies defining a vent passageway extending from a region located along an upper surface of the casting chamber. The method comprises heating the vent passageway to a temperature such that gas flowing through the vent passageway during a casting operation is maintained in a gas state.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
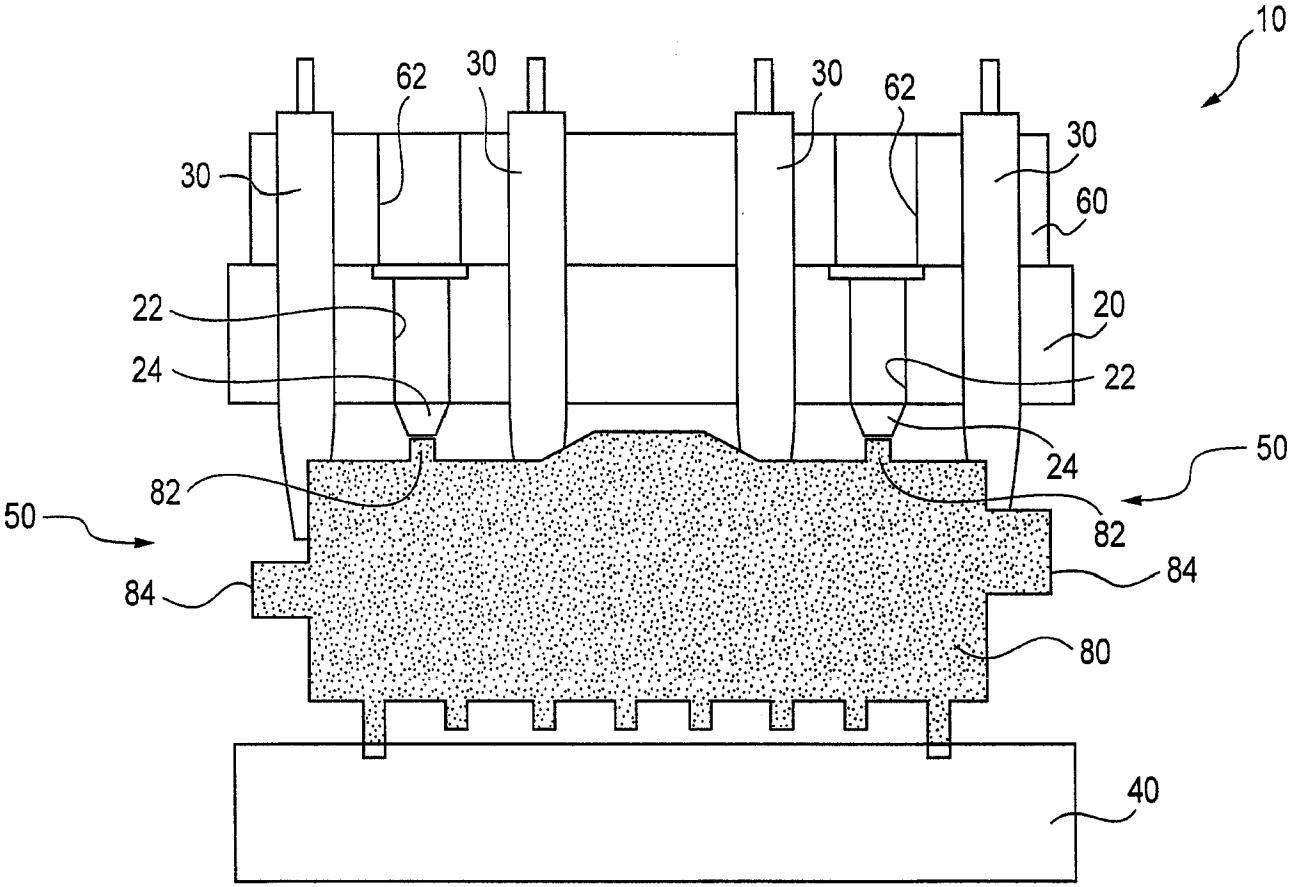
FIG. 1 is a schematic view of a preferred embodiment vented casting system in accordance with the present invention.

The present invention can be utilized in nearly any casting system in which molten metal is introduced into a casting chamber having one or more vents. Preferably, the casting system is a closed casting system. As will be appreciated, a closed casting system is distinguishable from an open casting system in which a casting region is generally directly accessible to the environment. A closed casting system is characterized by one or more casting chambers that are not in direct communication with the environment. Typically, a closed casting system comprises two or more dies, a cooling system, and a venting system. At least one of the dies is movable or otherwise positionable to enable removal of the cast item from the casting chamber. Typically, the dies can be positioned between an open state in which one or more of the dies are separated from one another a distance sufficient to allow the cast item to be removed from the dies, and a closed state in which the dies are positioned and tightly engaged or otherwise in contact with other die(s), so as to define the casting chamber. A gating system is typically provided to direct and control flow of the molten metal into the casting chamber. The cooling system may include passageways extending through one or more dies through which a heat transfer fluid passes. The venting system can utilize one or more vent passageways typically extending from the upper regions of the casting chamber to a collection system external to the dies. Venting may be vacuum assisted.

It has been discovered that in many vented casting systems, during operation, region(s) of the interior surfaces of the vents are at temperatures that induce deposition of materials within and/or entrained in the flowing vent gases. The deposition can be in the form of a transition from gas to liquid to solid phase, and/or a transition from gas directly to solid phase. It is also contemplated that small particulates of liquid and/or solid materials may be carried in the vent gases. And so, deposition can also be in the form of a transition from liquid to solid phase and/or no phase transition such as when solid particulates in the vent flows are deposited. As the hot vent gases flow past lower temperature surfaces in the vent passages, condensation and/or deposition occurs and buildup of materials on the vent surfaces results. That is, during a typical casting operation, regions in the vent passageways are frequently at temperatures low enough to cause deposition of materials in the vent gases such as for example, resinous materials from expendable cores. These resinous materials in the hot vent gases flowing past the lower temperature surfaces, then deposit on the vent surfaces.

In accordance with this discovery, the present invention provides and incorporates one or more heating elements in vent passageways so that condensation or deposition of materials in vent gases is avoided or at least significantly reduced. The heating elements are operated so that vent gases flowing through vent passageways are maintained at a temperature greater than the temperature(s) at which materials begin to condense or otherwise become deposited upon the interior surfaces of the vent passageways. Another feature of the present invention is that the heating elements are operated at temperatures such that materials prone to deposition on vent surfaces are decomposed to an extent whereby the potential for material buildup is significantly reduced and in certain applications avoided. In other aspects related to the present invention, for casting systems comprising cooling systems such as cooling jackets and/or chill blocks, the heater(s) are selectively located in the vent passageways so that their effect upon the cooling system is reduced. These aspects are described in greater detail herein.

Typically, the preferred embodiment systems and methods are utilized in a die casting operation using one or more expendable cores. A typical core is composed of foundry sand mixed with a binder or resin. Using heat, a catalyst or chemical reaction, the sand grains and binder are bonded together into a discrete shape, and can be used in the casting process. The heat given off during the solidification and cooling of the actual cast parts drives off moisture, or results in the chemical breakdown of the binder in the core. This permits relatively easy removal of the core from the casting. It is instructive to consider the typical composition of expendable cores. The core material is bound together through use of binding agents such as thermoplastic resins. Additional components such as suspending agents, additives, and solvents can be used to form the expendable core. A wide array of foundry sands is typically used. Heavier foundry sands such as zircon require less binder. Other common foundry sands can be used. An example of a preferred foundry sand is a mixture of silica sand and lake sand used in expendable cores. Such other sands would preferably require the use of binder amounts consistent with desired density. The choice of a specific binder level is generally dependent upon core shape, core thickness, complexity, the manner in which the core is secured within the casting dies, and casting conditions. The binder, mixed with foundry sand and an optional appropriate amount of oxidizing agent typically forms the core. Suitable acid curable resin binding systems include but are not limited to urea/formaldehyde, phenol/formaldehyde, furane, and copolymers of such resins. It is also possible to use copolymers of these resins with epoxidized compounds or with unsaturated compounds. Suitable resinous binding agents used in many cores include thermoplastic resins, vinyl toluene/butadiene copolymer, styrene/butadiene copolymer, vinyl toluene/acrylate copolymer, styrene/acetylene copolymers, or acrylate homopolymers. An oxidizing agent may be present in the binding system. The oxidizing agent functions to cure the resin. The binder system may contain resin such as a silane for example gamma-aminopropyltriethoxysilane.

Following its preparation, the core can be coated to further improve performance with respect to washout and surface penetration. Suitable core coatings generally comprise a suspending agent, a refractory material, a binding agent, and a liquid vehicle. A core coating is applied by brushing, dipping, spraying or an equivalent method. Once the coating is dry, the core is placed into a die, and specifically, in a casting chamber. Typical particulate refractory materials that are useful in the coating formulation include but are not limited to graphite, coke, silica, aluminum oxide, magnesium oxide, zircon, mica, talc and calcium aluminate. Suspending agents may also be used in expendable cores. These may include clay or clay derivatives. These materials are present in amounts sufficient to maintain the refractory material in suspension.

FIG. 1 is a schematic illustration of a preferred embodiment vented casting system 10 in accordance with the present invention. In the following description, the system 10 will be described in conjunction with casting a cylinder head. However, it will be understood that the present invention is not limited to such. The system 10 comprises a first die 20 and a second die 40. At least one of the dies is positionable so that the die(s) can be closed prior to a casting operation and opened, after the operation to allow removal of item(s) formed within a casting chamber 50 defined by the die(s), and generally therebetween. One or more cores, such as an expendable water jacket sand core 80, can be selectively positioned within the casting chamber 50 prior to performing a casting operation in which molten metal is administered into the chamber 50. The water jacket sand core 80 typically includes inlet and outlet ports 84 for flow of a heat transfer fluid therethrough in the resulting void in the subsequently cast cylinder head. The casting system 10 typically also comprises a chill block 60 disposed on one of the dies, for example the first die 20. A chill block is optional, however is generally used to cool an upper die, i.e. the die 20, at select times during a casting operation. One or more core pins 30 extend through at least a portion of the assembly. The core pins 30 form void(s) in the cylinder head as desired, such as in forming voids or recessed regions for spark plugs or other ignition components for example. A die may optionally include one or more core pins defined therein, that create voids in the resulting cast component which may serve a variety of different functions. The core pins or other voids defined in a die may also be provided with internal cooling passages. One or more vents are defined within one or more dies such as die 20, the chill block 60, and in association with the sand core 80. The vents provide passages in the casting system 10 through which gases can flow, and more specifically, exit the casting chamber 50.

Specifically, a typical vent passage or passageway is defined by an upper vent port 82 provided along a region of the sand core 80, which is accessible from the casting chamber 50. The die 20 includes a passage defined by an interior vent passage surface 22 extending from the port 82, and specifically from a lower vent port 24, to an upper region of the die 20. The chill block 60 disposed on the die 20, includes a corresponding passage defined by an interior vent passage surface 62. The vent passage 62 extends from the upper region of the die 20 at which the vent passage 22 is accessible, to an upper region of the chill block 60. It will be appreciated that the vent passages in the die 20 and the chill block 60 are preferably aligned with one another to provide communication between the casting chamber 50 and the upper region of the chill block 60. A gas collection system (not shown) or other venting system is preferably in communication with each of these vents. As previously noted, venting may be vacuum assisted. A typical vented casting system comprises one or more vents from the casting chamber, and preferably two or more.

Figure 2:
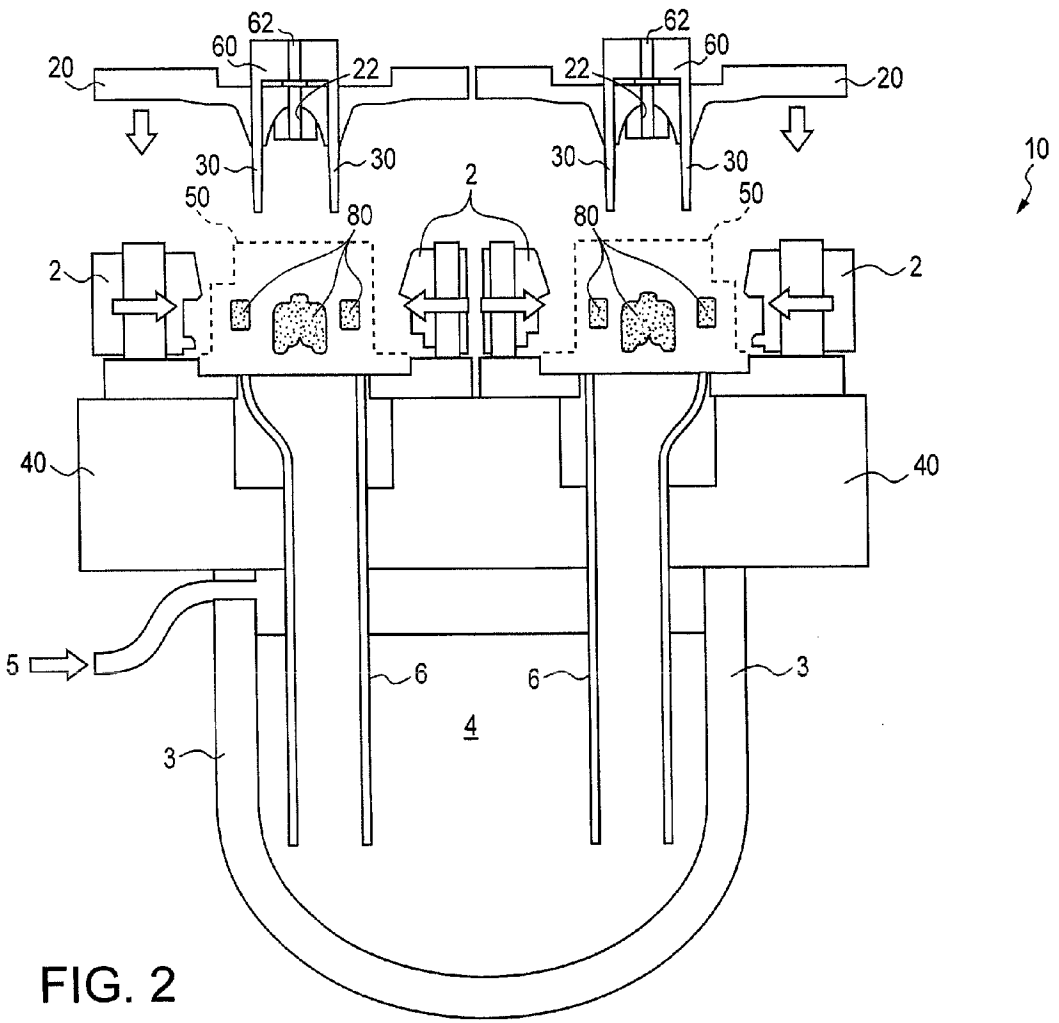
FIG. 2 is another schematic view of the preferred embodiment vented casting system.

FIG. 2 is a schematic illustration of an end view of the casting system 10 depicted in FIG. 1. The first die 20 and portions of the chill block 60 disposed thereon are shown. Die 20 is generally vertically positionable with respect to the second die 40. A plurality of laterally positionable secondary die members 2 are shown, disposed between the first and second dies 20, 40. It will be appreciated that upon appropriate positioning of the dies 2, 20, and 40, the casting chamber 50 is defined. Positioned within the casting chamber 50 is the expendable water jacket sand core 80.

The casting system 10 further comprises a molten metal vessel 3 containing molten metal 4 such as steel or aluminum for example, for introduction into the casting chamber 50. A plurality of conduits 6 extend through the die 40 and provide flow communication between the casting chamber 50 and the vessel 3 containing molten metal 4.

A typical casting operation using the system depicted in FIG. 2 is as follows. An effective amount of molten metal 4 is administered into the vessel 3, prior to casting. Another operation before casting occurs is positioning of the expendable water jacket sand core 80 within the region between dies 2, 20, and 40, and specifically, within the desired region of the casting chamber 50. The dies 2 are laterally positioned toward a respective portion of the sand core 80, and the die 20 is displaced and positioned toward the die 40 so as to define the casting chamber 50. Upon introduction of pressured air 5 into the vessel 3, and specifically above the surface of the molten metal 4 contained therein, molten metal 4 is directed into the casting chamber 50 from the vessel 3, through conduits 6.

After introduction of the molten metal 4 into the casting chamber 50 and around the sand core 80, the metal 4 within the chamber 50 begins to cool and eventually solidifies. The chill block 60 assists in such cooling and serves as a heat sink as it conducts heat from the cooling mass of metal in the chamber 50, such cooling further assisted by the core pins 30 extending into the metal 4 in the chamber 50. As previously explained, upon exposure to the hot molten metal 4 in the chamber 50, the sand core 80 decomposes and produces relatively large amounts of gas. The gas is vented out of the chamber 50 by vent passages 22 and 62 defined in the first die 20 and the chill block 60, respectively.

Upon sufficient cooling and preferably, at least partial solidification of the molten metal 4 in the casting chamber 50, remaining amounts of molten metal 4 are returned back to the vessel 3 by transfer through the conduits 6.

Figure 3:
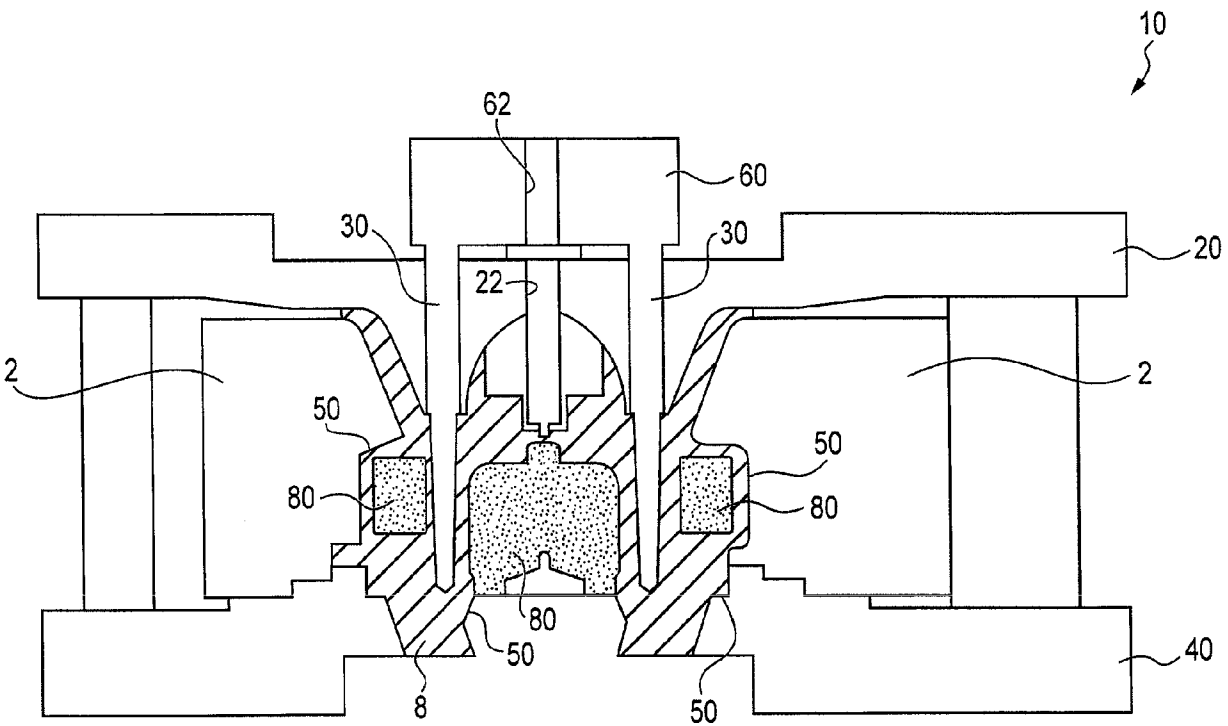
FIG. 3 is yet another schematic view of the preferred embodiment vented casting system.

FIG. 3 is a schematic illustration of the casting system 10 depicted in FIG. 2 after a pair of the secondary die members 2 have been laterally positioned toward one another, and the first die 20 has been vertically positioned towards the second die 40, so as to define the casting chamber 50. FIG. 3 illustrates a cast metal component 8, such as an engine cylinder head cast within the chamber 50. The cast component 8 includes hollow or undercut regions produced by the sand core 80.

In accordance with the present invention, a wide array of heaters, heating devices, and/or heating elements can be incorporated in vents or vent passageways in a casting system. In a preferred embodiment, a cylindrical heater using an electrical heating element is used. The cylindrical tube heater is sized and shaped to reside within a vent passage. It is also contemplated that the heater can be formed within the vent passage. A liner is preferably used within the cylindrical heater to prevent contact with vent gases flowing through the heating assembly. The liner preferably contacts the vent gases. The liner or internal sleeve is optional, however preferably is used with the noted hollow tube heater. The liner is sized and adapted to fit within and preferably engage the interior surface of the tube heater. The liner may also be configured to provide holding and support elements for the tube heater. And, the liner may be configured to serve as a mounting structure for the tube heater. Furthermore, the liner may be sized and configured as a chimney or stack to promote expelling of gases in the vent flows. In this regard, the liner may also reduce the potential for buildup or deposition of materials in vent flows along surface regions adjacent or near the vent exit. The liners are preferably formed from a material having a relatively high thermal conductivity coefficient, such as metal. Generally, air is a poor conductor of heat, and so use of a metallic liner between the heat source and the flowing vent gases promotes heat transfer from the heater to the exposed surfaces of the liner, alongside which vent gases flow.

Figure 4:
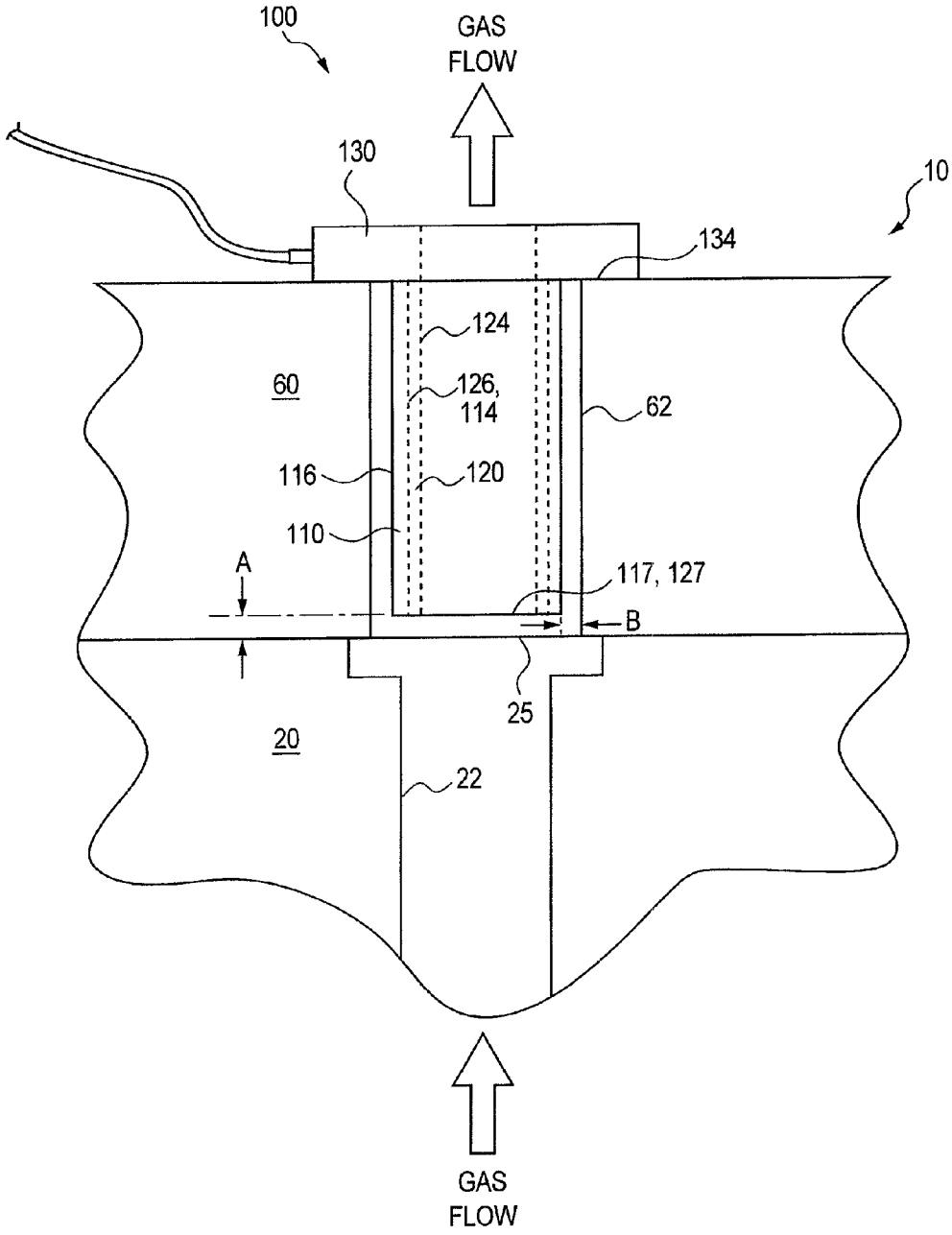
FIG. 4 is a detailed schematic view of a heating assembly and its incorporation in a casting system in accordance with a preferred embodiment of the present invention.

Referring to FIG. 4, a detailed schematic view of a preferred embodiment heating assembly disposed within a vent passage is depicted. There, an upper region of the casting system 10 from FIG. 1 is shown, revealing a portion of the first die 20 and a chill block 60 disposed thereon. A vent passage surface 22 defined in the die 20 extends from the casting chamber (not shown) to an interface region 25 at which the vent continues by a vent passage surface 62 defined in the chill block 60. A preferred embodiment heating assembly 100 is depicted disposed within the vent and immediately adjacent to the vent passage surface 62 defined in the chill block 60. The heating assembly 100 preferably comprises a cylindrically shaped heater 110 that is fittingly positioned within the vent, and a liner 120 appropriately shaped and sized to fit within and engage the interior of the heater 110. FIG. 4 also depicts a typical direction of gas flow during a casting operation. Additional aspects illustrated in FIG. 4 are described herein.

Figure 5:
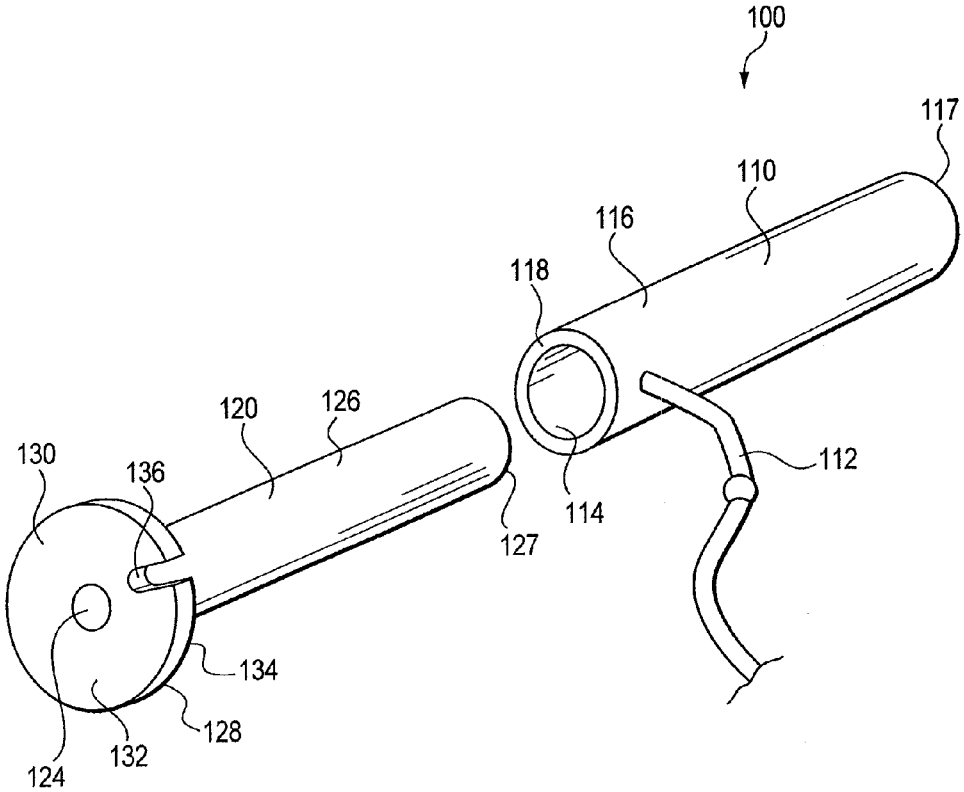
FIG. 5 is an exploded view of a preferred embodiment heating assembly in accordance with the present invention.

FIG. 5 is an exploded view of the preferred embodiment heating assembly 100. The heating assembly comprises the heater 110 and the liner 120 engageable therewith. The heater 110 is preferably a cylindrically shaped tube heater defining a distal end 117, an opposite proximal end 118, an interior surface 114 extending between the ends 117 and 118, and an oppositely directed outer surface 116 also extending between the ends 117 and 118. The heater 110 comprises one or more heating elements such as electrical resistive heating elements, preferably formed or encased within the wall(s) of the heater 110. One or more power and/or control cables 112 extend from the heater 110 for controlling and/or powering the heating elements.

The liner 120 of the heating assembly 100 is preferably cylindrically shaped also, and sized and configured to fit within the heater 110. The liner 120 defines a distal end 127, an opposite proximal end 128, an interior surface 124 that defines a passage extending between the ends 127 and 128, an enlarged head 130 defining a top surface 132 and an underside 134, and an exterior surface 126 generally extending between the underside 134 of the head 130 and the distal end 127. The head 130 also preferably defines an access slot 136 such that when the liner 120 is inserted within the interior of the heater 110, the cable 112 extending from the exterior of the heater 110 is free from interference with the liner 120 and specifically, the head 130 of the liner. That is, the cable 112 is preferably fittingly received and positioned within the slot 136.

Referring again to FIG. 4, a preferred configuration of the heating assembly 100 is shown and described as follows. The heater 110 is preferably disposed within a vent passage in the chill block 60 and specifically, within the vent defined by vent passage surface 62. The heater 110 is preferably concentrically aligned and centered within that passage such that the exterior surface 116 of the heater 110 is spaced a distance B from the vent passage surface 62. Distance B is preferably the same around the circumference of the heater 110. Distance B is preferably about 1 mm. However, the present invention includes a wide array of other configurations in which this distance is greater than or less than 1 mm. The liner 120 is preferably disposed within the heater 110 such that the exterior surface 126 of the liner 120 is in contact with the interior surface 114 of the heater 110. As will be appreciated, this promotes heat transfer from the heater 110 to the interior surface 124 of the liner 120 alongside which vent gases flow. The heating assembly 100 can be supported by the underside 134 of the head 130 of the liner 120 being in contact with the chill block 60. It is preferred that the distal ends 117 and 127 of the heater 110 and the liner 120, respectively, do not extend into the vent passage defined in the upper die, i.e. die 20. Specifically, it is preferred that the ends 117 and 127 are maintained a distance A from the die 20. Preferably distance A is about 1 mm. However, the present invention includes a wide array of other configurations in which this distance is greater than or less than 1 mm.

The configuration of the heating assembly 100 and particularly, its orientation and spacing from the chill block vent passage 62 and the interface region 25 is such that the heating effect upon the adjacent components is significantly reduced. That is, by spacing the heater 110 from the chill block vent passage 62 a distance B, heating of the chill block 60 is reduced. Similarly, by spacing the heater 110 and specifically, the distal end 117 of the heater from the interface 25 of the die 20 a distance A, heating of the die 20 is reduced. Such reductions in heating that would otherwise occur, impose less cooling burdens on the casting cooling system.

Figure 6:
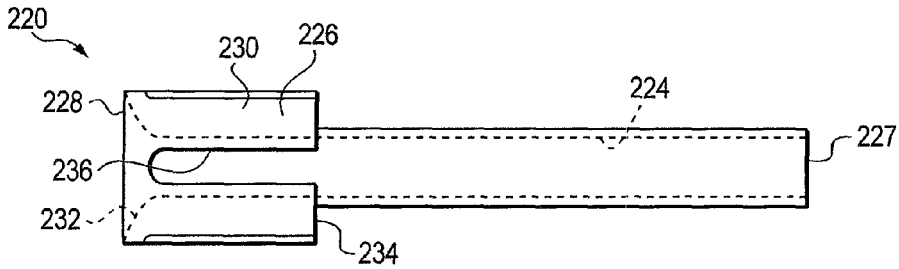
FIG. 6 is a side elevational view of a component of another preferred embodiment heating assembly in accordance with the present invention.
Figure 7:
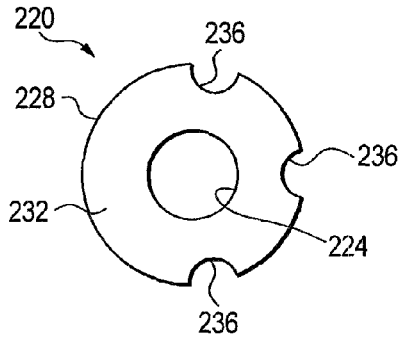
FIG. 7 is an end view of the component depicted in FIG. 6.
Figure 8:
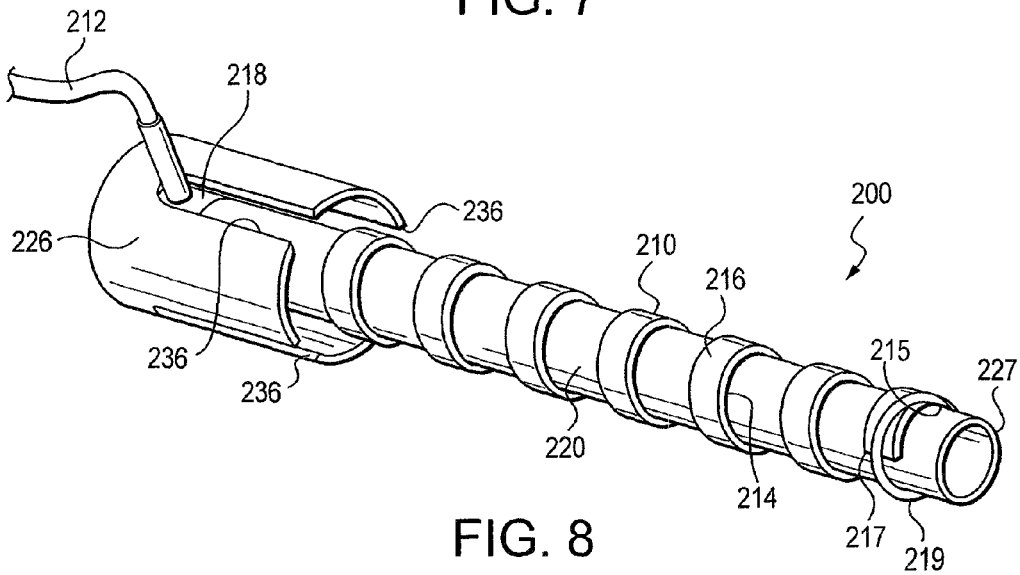
FIG. 8 is a perspective view of another preferred embodiment heating assembly using the component shown in FIGS. 6 and 7.

FIGS. 6-8 illustrate another preferred embodiment heating assembly 200. The heating assembly 200 comprises a coil heater 210 and a liner 220 engageable therewith. FIGS. 6-7 illustrate the liner 220. The heater 210, shown in FIG. 8, is preferably a coiled or helically wound heating member that defines a distal end 217, and opposite proximal end 218, an interior surface 214 and an exterior surface 216, the surfaces 214 and 216 generally constituting the inner and outer faces of the coil heating member. One or more power and/or control cables 212 extend from the heater 210 for controlling and/or powering the heating member.

The liner 220 of the heating assembly 200 is preferably cylindrically shaped and sized and configured to fit within the heater 210, and preferably, within the coils of the heating member of the heater 210. The liner 220 defines a distal end 227, an opposite proximal end 228, an interior surface 224 that defines a passage extending between the ends 227 and 228, an enlarged head 230 defining a top surface 232 and an underside 234, and a circumferential exterior surface 226 generally extending between the underside 234 of the head 230 and the proximal end 228. Preferably, the top surface 232 is concave and slopes inwardly to its interface with the interior surface 224. The head 230 also preferably defines one or more access slots 236 such that when the heater 210 is inserted about the longitudinal portion of the liner 220, the cable 212 extending from the heater is free from interference with the liner 220. Preferably, the cable 212 is disposed within one of the slots 236. Additional aspects depicted in FIG. 8 are described herein.

Figure 9:
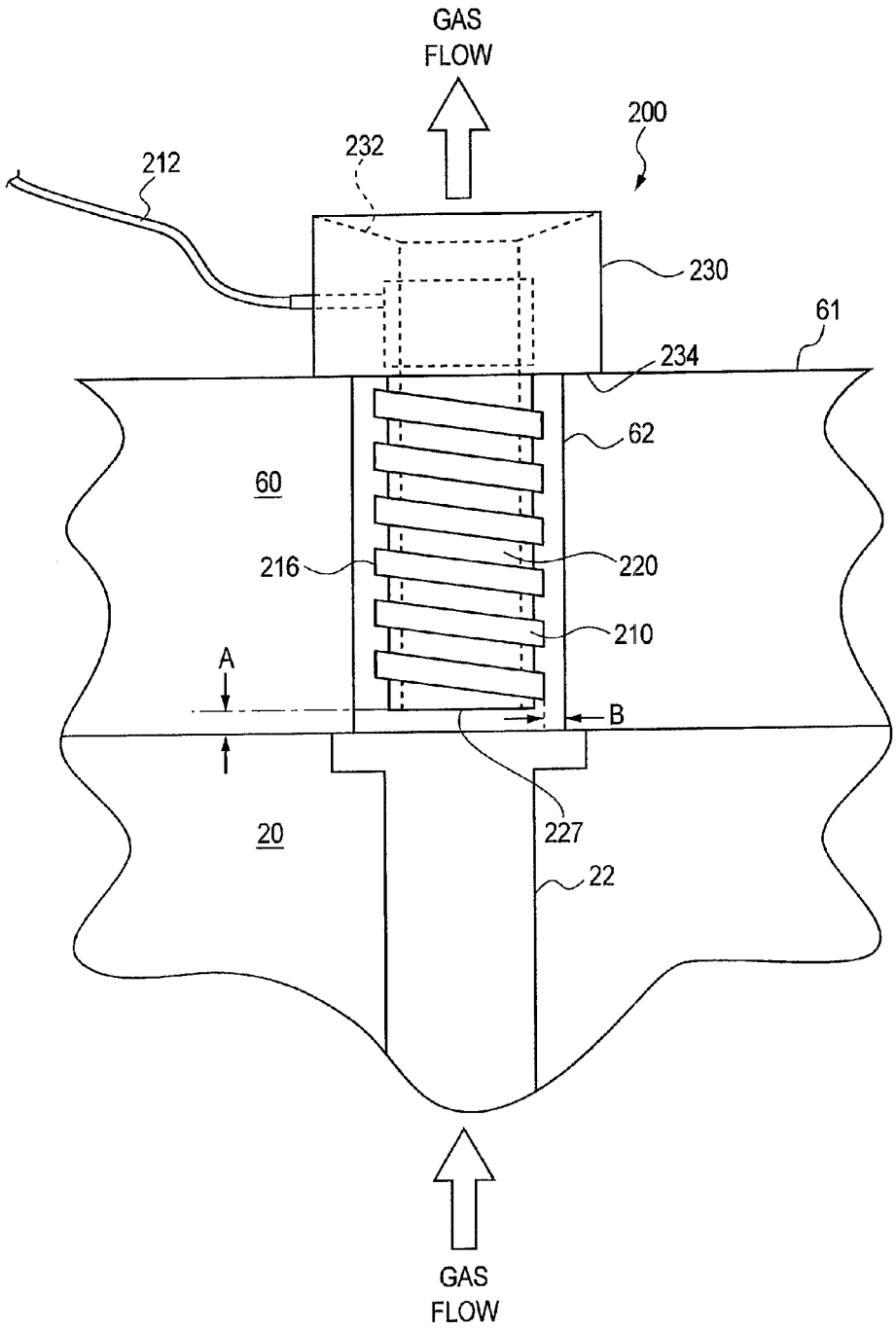
FIG. 9 is a detailed schematic view of the heating assembly depicted in FIGS. 6-8 and its incorporation in a casting system in accordance with another preferred embodiment of the present invention.

FIG. 9 illustrates the preferred embodiment heating assembly 200 disposed within the vent passage 62 in the chill block 60, and preferably concentrically aligned and centered within that passage such that the exterior surface 216 of the coiled heating member is spaced the distance B from the vent passage surface 62. Distance B is as previously described with regard to FIG. 4. The heating assembly 200 is also preferably supported by an upper surface 61 of the chill block, such that the underside 234 of the head 230 is disposed upon and in contact with the surface 61.

As previously explained with regard to the heating assembly 100 as depicted in FIG. 4, the distal end 227 of the liner 220, which may be proximate the distal end 217 of the coiled heating member, is preferably spaced a distance A from the die 20. Distance A is as previously described with regard to FIG. 4.

Referring further to FIGS. 6-9, additional preferred aspects of the heating assembly, such as assembly 200, are as follows. The head 230 of the liner 220 can be formed to define additional slots 236 so as to further reduce the amount of surface area of the underside 234. This practice would thus reduce the potential for heat transfer between the liner 220 of the heating assembly 200 and the chill block 60. In addition, by forming the top surface 232 as a concave surface, and to slope inwardly and downwardly from the circumferential outer region of the end 228 to the interior surface 224, the effective length of the heater 210 can be reduced, thereby reducing the potential for heat energy to be lost. Referring to FIG. 8, in certain preferred versions of the heating assembly, a snap ring or other resilient member can be used to hold or otherwise retain the heater 210 with respect to the liner 220. One or more corresponding grooves can be defined in the liner 220 to receive the noted snap ring(s). Preferably, a single groove 215 is defined along the end 227 of the liner 220, and a resilient member 219 is placed about the end 227 of the liner 220 and in engagement with the heater 210. The member 219 is preferably positioned within the groove 215. This configuration serves to affix the end of the coil heater to the liner.

It will be appreciated that the preferred embodiment heating assemblies 100 and 200 can be used without the chill block 60 depicted in FIGS. 4 and 9. For casting operations in which a chill block is not used, the heating assembly is sized and configured to extend within the vent passage defined in the uppermost die, such as die 20. The heating assembly would preferably be disposed and supported upon the first die, and preferably, upon an upwardly directed surface or face thereof.

Preferably, the heater assembly is disposed along at least a majority of the length of the vent passage defined in the cooling block. Most preferably, the heater assembly is disposed along the entirety of the length of this vent passage, or substantially so. Depending upon the particular application and casting system, it may also be generally preferred to not dispose or otherwise locate the heating assembly in the vent passage defined in the die. In these applications, the heating assembly, typically disposed in the cooling block, is preferably spaced from the die a distance of at least about 1 mm.

In a particularly preferred embodiment, the present invention method not only prevents or at least significantly reduces the potential for deposition of materials within certain regions of vent passages, i.e. proximate the heaters; but also reduces the deposition of materials throughout an entire vent system. Although not wishing to be limited to any particular theory, it is believed that this feature of the invention results from heating the vent gas to a relatively high temperature sufficient to cause decomposition, or at least partial decomposition and/or deterioration, of material(s) in the gas otherwise prone to deposit on surfaces within the vent system.

In a preferred method according to the present invention, one or more heaters are incorporated or otherwise disposed in a vent passageway in a die casting system. The heaters are operated so as to prevent deposition of material(s) from the vent gas onto interior surface(s) within the vent system. Generally, the heaters are operated at temperatures of from at least 250° C., more preferably at least 300° C., more preferably at least 325° C., and most preferably at least about 350° C. Additionally, as noted, in certain aspects according to the present invention, the heaters decompose and/or deteriorate one or more materials in the vent flows and thus, significantly reduce the potential for material buildup. In accordance with this aspect, it is preferred that the heaters be operated at temperatures of at least about 350° C. Temperatures as high as 500° C. are contemplated, however, it is believed that for most applications sufficient decomposition can be achieved by heater(s) operating in the temperature range of from 300° C. to 500° C. It will be noted that these temperatures are temperatures of the heaters, i.e. the heating elements. Accordingly, temperatures measured along the interior surface of the liner, alongside which vent gases flow, will be lower. Generally, depending upon the configuration and materials used in the heating assemblies, such surface temperatures are about 90° C. to about 110° C. less than temperatures of the heating element. Thus, in order to achieve a desired surface temperature along the liner, the heating element is typically operated at a temperature of about 100° C. greater than the surface temperature desired.

For the preferred embodiment heating assembly 200 and its incorporation in a casting system using a chill block, such as depicted in FIG. 9, a heater set point temperature of from about 450° C. to about 480° C. has been found to provide excellent results. This set point temperature range has been found to result in an internal temperature of from about 320° C. to about 340° C. as measured within the vent passage of the chill block.

Figure 10:
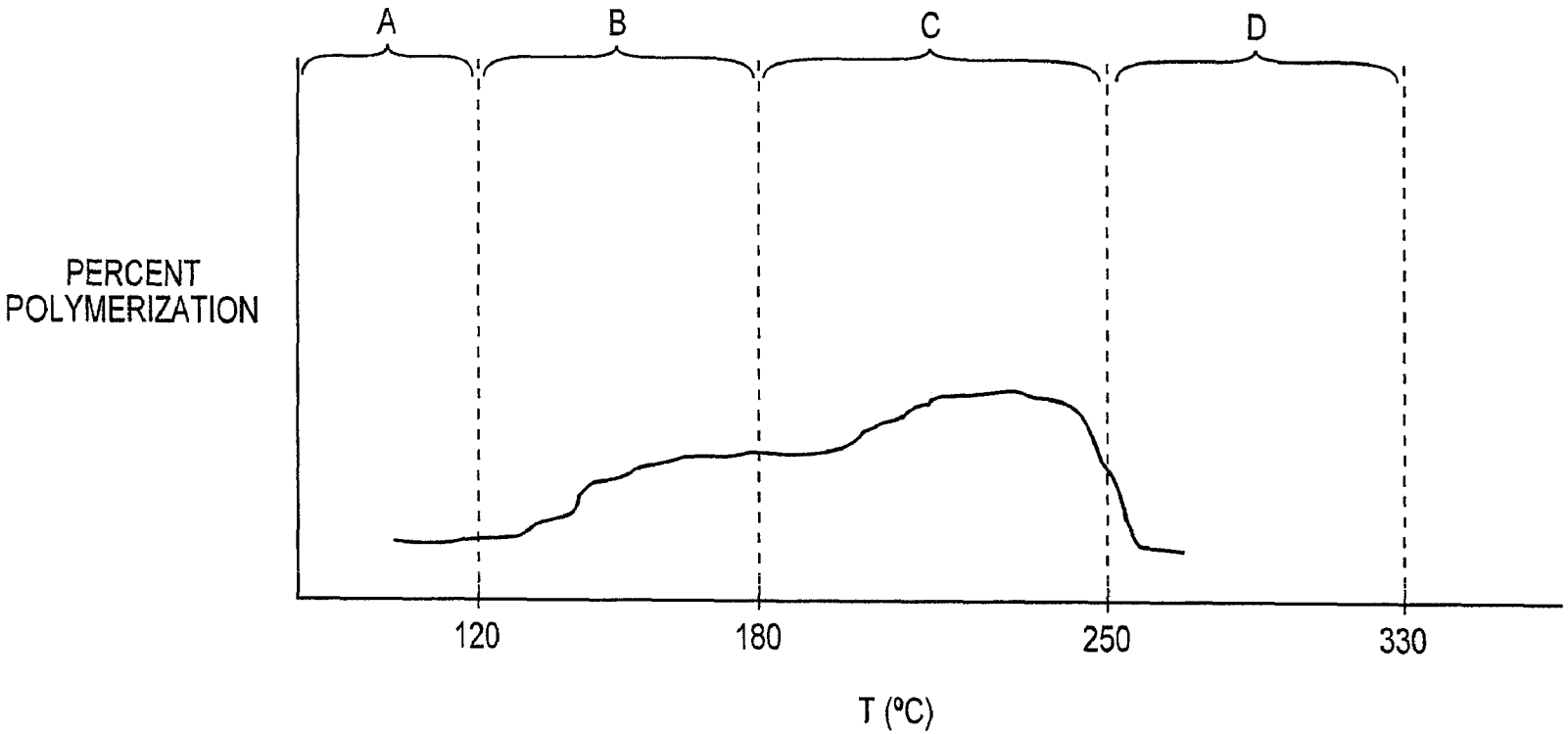
FIG. 10 is a graph illustrating an aspect of a preferred embodiment method according to the present invention.

FIG. 10 illustrates a typical relationship between the extent of deposition or buildup of resin gas on vent surfaces as a function of temperature of the vent gas. The vent gas system shown in FIG. 10 is that of a phenol/formaldehyde binder system. The extent of deposition is characterized as the percent polymerization, shown on the vertical axis. The percent polymerization represents the percent of resinous gas in the vent gas flow that deposits and/or solidifies on the vent surfaces. In region A, where vent gases are at relatively low temperatures, i.e. less than 120° C., the percent polymerization of vent gases is relatively low. Within this range, decomposition of the vent gases does not occur to any appreciable extent. Within region B, i.e. from 120° C. to 180° C., a buildup of solidified deposits begins to occur on vent surfaces, if heating of those surfaces is not performed. Typically, these deposits are comprised of various phenol compounds, formaldehyde, and related compounds. In region C, i.e. from 180° C. to 250° C., significant deposition occurs as many oxides of the phenol based compounds form. This is the temperature range within which results the highest rate of deposition of vent gas materials on vent surfaces. At temperatures greater than 250° C., i.e. within region D, the buildup of materials on vent surfaces is significantly reduced. This is believed to be due at least in part from decomposition or carbonization of the solidified materials on vent surfaces. In addition, it is believed that deposition of many phenol based compounds is precluded at such relatively high temperatures due to the fact that the boiling point of many such compounds is about 180° C. However, it is understood that the particular temperature(s) selected for operating the preferred heating assemblies depends upon numerous factors such as the composition of vent flows, the rate of the vent flows, the temperatures of the vent flows, the materials of the heating assemblies and their corresponding thermal conductivities, and the heat transfer characteristics of the heating assembly liner surfaces and configuration of the vent passages. As noted, the system illustrated in FIG. 10 is that a phenol/formaldehyde system. Other binder systems may exhibit different behavior and at slightly different temperatures.

Preferably, heating elements with integral temperature sensors such as thermocouples are utilized in the heating assembly and related methods according to the present invention. Temperature sensors are preferably used with electronic temperature monitoring and/or temperature controllers that govern operation of the heaters, as described in greater detail herein. As will be appreciated, the selection of the type of thermocouple depends upon the range of temperatures to be sensed. Types J or K are suitable for most applications as Type J thermocouples sense temperatures in the range of from −20° C. to 760° C. and Type K sense temperatures from −20° C. to 1260° C. The heat output of such heaters depends upon the specific application, but heaters of wattages 500 to 1500 watts, and preferably 750 watts, are suitable for incorporation in most vents in accordance with the present invention. It is contemplated that for certain casting systems, and particularly, for those that do not use a chill block, power levels for suitable heaters can be less than 500 watts, for example from about 250 watts up to about 550. The particular wattage level or range of wattages will depend upon a variety of factors. A cylindrically shaped coiled cable heater having a stainless steel sheath and rated for up to 750° C. using a Type J or Type K thermocouple is available from Thermetic Products, Inc. of Minneapolis, Minn. Additional suitable coiled cable heaters are available from Watlow Co. of Winona, Minn.

Temperature control and monitoring of one or more heater (s) in vent passageways is preferably performed by an electronic processor. Control algorithms as known by those skilled in the art, can be used to control operation of the heaters, heating devices, and/or heating elements. A preferred commercially available electronic controller is available under the designation EZ-ZONE™ PM from Watlow Co. of Winona, Minn.

It will be understood that although the preferred embodiment heating assemblies are described and depicted herein having tubular or cylindrical shapes, the present invention is not limited to such. That is, the invention includes a wide array of shapes, styles, and configurations for the heating assembly and its components. Furthermore, it is contemplated that multiple heating assemblies can be used in a single vent passage. Heating assemblies can also be disposed and positioned at nearly any location in a vent passage. However, it will be appreciated that heating assemblies are preferably located at those locations at which deposits occur. Also, it is envisioned that heating assemblies could be located directly in die vents, depending upon the particular application.

In addition to using electrical heaters as described herein, it is also contemplated that a wide array of other heaters and heater types can be used. For example, gas-fired heaters could be used and optionally with heat transfer fluids that transfer thermal energy along the interior vent surfaces. It is also contemplated to heat the interior vent surfaces with steam, and preferably superheated steam.

It will be understood that the present invention in no way is limited to casting using expendable cores. That is, the present invention can be implemented in a wide array of casting operations, which may or may not use cores. Examples of such casting processes include, but are not limited to low pressure casting, gravity casting, high pressure casting, tilt casting etc.

Many other benefits will no doubt become apparent from future application and development of this technology.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A vented metal casting system comprising:

a first die defining a first interior casting surface adapted to receive and contact molten metal;

a second die defining a second interior casting surface adapted to receive and contact molten material, the second die positionable with the first die between open and closed states such that upon positioning the second die in a closed state, the first interior casting surface and the second interior casting surface define an interior casting chamber;

wherein at least one of the first die and the second die define a vent passageway extending from a region located along an upper surface of the casting chamber;

a heating element in thermal communication with the vent passageway, the heating element positioned in the vent passageway to prevent or at least substantially prevent material deposition from gases flowing through the vent passageway from the casting chamber during a casting operation, the heating element positioned spaced apart from an internal vent surface defining the vent passageway to reduce heating of the die.

2. The vented metal casting system of claim 1 further comprising:

an expendable core disposed in the casting chamber, the core comprising a resinous material that upon exposure and heating from molten metal in the casting chamber during a casting operation, volatilizes into a gas.

3. The vented metal casting system of claim 1 wherein the heating element defines an internal surface exposed to gases flowing through the vent passageway.

4. The vented metal casting system of claim 3 wherein the surface of the heating element is at a temperature greater than the temperature at which the gases flowing through the vent passageway deposit.

5. The vented metal casting system of claim 4 wherein during a casting operation, the heating element is at a temperature of at least 300° C.

6. The vented metal casting system of claim 5 wherein the heating element is at a temperature of at least 325° C.

7. The vented metal casting system of claim 6 wherein the heating element is at a temperature of at least 350° C.

8. The vented metal casting system of claim 1 wherein the heating element is centered within the vent passageway and spaced from the internal vent surface defining the vent passageway, a distance of about 1 mm.

9. A vented casting system comprising:

a plurality of dies, the dies defining a casting chamber for receiving molten metal in a casting operation;

a cooling block in thermal communication with at least one of the dies;

a vent passage defined by at least one of the dies and the cooling block, the vent passage extending from the casting chamber and adapted to direct gases out of the casting chamber; and a heating assembly disposed in the vent passage, the heating assembly positioned spaced apart from an internal vent surface defining the vent passage to reduce heating of the die and the cooling block.

10. The vented casting system of claim 9 wherein the heating assembly comprises (i) a heater sized and shaped to be fittingly disposed within the vent passage, the heater defining an interior hollow region, and (ii) a liner sized and shaped to be fittingly disposed within the interior hollow region of the heater.

11. The vented casting system of claim 9 wherein during a casting operation, the heating assembly is at a temperature of at least 300° C.

12. The vented casting system of claim 11 wherein the heating assembly is at a temperature of at least 325° C.

13. The vented casting system of claim 12 wherein the heating assembly is at a temperature of at least 350° C.

14. The vented casting system of claim 9 wherein the heating assembly is disposed in the vent passage in the cooling block and centered within the vent passage and spaced from an internal vent surface defining the vent passage, a distance of about 1 mm.

15. The vented casting system of claim 9 wherein the heating assembly is disposed in the vent passage in the cooling block such that a proximal end of the heating assembly is spaced from an adjacent die by a distance of about 1 mm.

16. A method for preventing or at least substantially preventing deposition of materials in a vent flow from a casting chamber during a casting operation in a casting system including at least two dies positionable between an open state and a closed state and which define when in the closed state the casting chamber, at least one of the first and second dies defining a vent passageway extending from a region located along an upper surface of the casting chamber, the method comprising:

positioning a heating element in the vent passageway spaced apart from an internal vent surface defining the vent passageway to reduce heating of the die; and heating the vent passageway to a temperature such that gas flowing through the vent passageway during a casting operation is maintained in a gas state.

17. The method of claim 16 wherein the casting system includes an expendable core disposed in the casting chamber, the core comprising a resinous material that upon exposure and heating from molten metal in the casting chamber during a casting operation, volatilizes into a gas.

18. The method of claim 16 wherein the heating results in at least a portion of the vent passageway reaching a temperature of at least 300° C.

19. The method of claim 16 wherein the heating results in at least a portion of the vent passageway reaching a temperature of at least 325° C.

20. The method of claim 16 wherein the heating results in at least a portion of the vent passageway reaching a temperature of at least 350° C.

* * * * *